US011596943B2

(12) United States Patent
Murakami et al.

(10) Patent No.: US 11,596,943 B2
(45) Date of Patent: Mar. 7, 2023

(54) MULTI HOLE INLET STRUCTURE

(71) Applicant: Canon Virginia, Inc., Newport News, VA (US)

(72) Inventors: Yoichi Murakami, Newport News, VA (US); Makoto Ogusu, Yorktown, VA (US); Christina Pysher, Hampton, VA (US); Scott Sundberg, Yorktown, VA (US); Chris J Felice, Newport News, VA (US); David Li, Newport News, VA (US)

(73) Assignee: Canon Virginia, Inc., Newport News, VA (US)

( * ) Notice: Subject to any disclaimer, the term of this patent is extended or adjusted under 35 U.S.C. 154(b) by 326 days.

(21) Appl. No.: 16/045,537

(22) Filed: Jul. 25, 2018

(65) Prior Publication Data

US 2020/0030800 A1 Jan. 30, 2020

(51) Int. Cl.
*B01L 3/00* (2006.01)

(52) U.S. Cl.
CPC ..... *B01L 3/502746* (2013.01); *B01L 3/50273* (2013.01); *B01L 2200/0642* (2013.01); *B01L 2300/0867* (2013.01); *B01L 2300/161* (2013.01); *B01L 2400/049* (2013.01); *B01L 2400/084* (2013.01)

(58) Field of Classification Search
CPC ..... B01L 3/52; B01L 2300/161; B01L 2400/084; B01L 2400/049; B01L 3/502746; B01L 3/50273; B01L 2200/0642; B01L 2300/0867; B01L 2200/027
See application file for complete search history.

(56) References Cited

U.S. PATENT DOCUMENTS

2010/0159590 A1* 6/2010 Alley ..... C12M 23/40 435/374
2011/0104688 A1* 5/2011 Sundberg ..... C12Q 1/6844 264/293
2013/0001145 A1* 1/2013 Yin ..... G01N 30/6017 210/198.2
2013/0139895 A1* 6/2013 Vangbo ..... F04B 43/043 137/2
2013/0345096 A1 12/2013 Wan
2014/0179021 A1 6/2014 Parkinson
2019/0001237 A1* 1/2019 Collins ..... B01D 15/362
2020/0124508 A1* 4/2020 Mendoza ..... G01N 33/492

FOREIGN PATENT DOCUMENTS

FR 2799139 A1 * 4/2001 ..... B01L 3/5027

OTHER PUBLICATIONS

Chung, A hybrid microfluidic-vacuum device for direct interfacing with conventional cell culture methods. BMC Technology. (Year: 2007).*
FR_2799139_A1_1_tranlsation . Yves et al. (Year: 2001).*

* cited by examiner

*Primary Examiner* — Rebecca M Fritchman
(74) *Attorney, Agent, or Firm* — Canon U.S.A., Inc. IP Division

(57) ABSTRACT

Some embodiments of a micro-fluidic device include at least one inlet hole located on an inlet side of the microfluidic device, the inlet hole consisting of a plurality of holes with diameters smaller in size than a diameter of the at least one inlet hole, at least one outlet hole located on an outlet side of the microfluidic device opposite the inlet side; and a micro-channel, where the plurality of holes are connected to the micro-channel.

20 Claims, 8 Drawing Sheets

MULTI HOLE INLET STRUCTURE

BACKGROUND

Technical Field

This application generally relates to the structure of microfluidic devices.

Background

In one of the methods for Polymerase Chain Reaction (PCR) and/or High Resolution Melt (HRM) sample analysis, reagents are introduced into micro-channels of a microfluidic device to test the samples, where the micro-channels are repeatedly refilled. Since the reagent needs to remain still in the micro-channel during testing, a capillary force is usually used to retain the reagent within the sample inlet.

In one technique, the micro-channel is initially filled with a first reagent. A pipette is then used to form a droplet of a second reagent, where the pipette dispenses the droplet via a sample inlet hole. The micro-channel is connected with a pump via an outlet hole, where the first and second reagents are vacuumed out in order to introduce a sample reagent. The droplet continues to be pulled into the micro-channel until the air-liquid interface of the second reagent is formed at the sample inlet hole. The air-liquid interface is retained because the vacuum pressure is under a Laplace pressure. Repeating the above-described process enables several test samples to be introduced into the micro-channel for analysis.

One issue with the above-described process is that the sample inlet hole size can be smaller than the droplet size, making it difficult to drop droplets via the smaller sized sample inlet hole. One solution to this issue is to align the tip of the pipette to the sample inlet using guide fixtures and/or pipette tips. This can result in a cost increase. Another solution is to enlarge the size of the sample inlet hole. However, in increasing the size, the smaller the Laplace pressure becomes, resulting in a decrease in the flow velocity of the reagent, which results in an increase in processing time. Also the smaller Laplace pressure becomes harder to control with a feedback loop and has an increased risk of breaking the air-liquid interface What is needed is a microfluidic introduction system that addresses and overcomes the above described issues.

SUMMARY

According to at least one aspect of the present disclosure, a microfluidic device includes at least one inlet hole located on an inlet side of the microfluidic device, the inlet hole consisting of a plurality of holes with diameters smaller in size than a diameter of the at least one inlet hole, at least one outlet hole located on an outlet side of the microfluidic device opposite the inlet side, and a micro-channel, wherein the plurality of holes are connected to the micro-channel.

DESCRIPTION

The following paragraphs describe certain exemplary embodiments. Other embodiments can include alternatives, equivalents, and modifications. Additionally, the exemplary embodiments can include several novel features, and a particular feature may not be essential to some embodiments of the devices, systems, and methods that are described herein.

Figure 1:
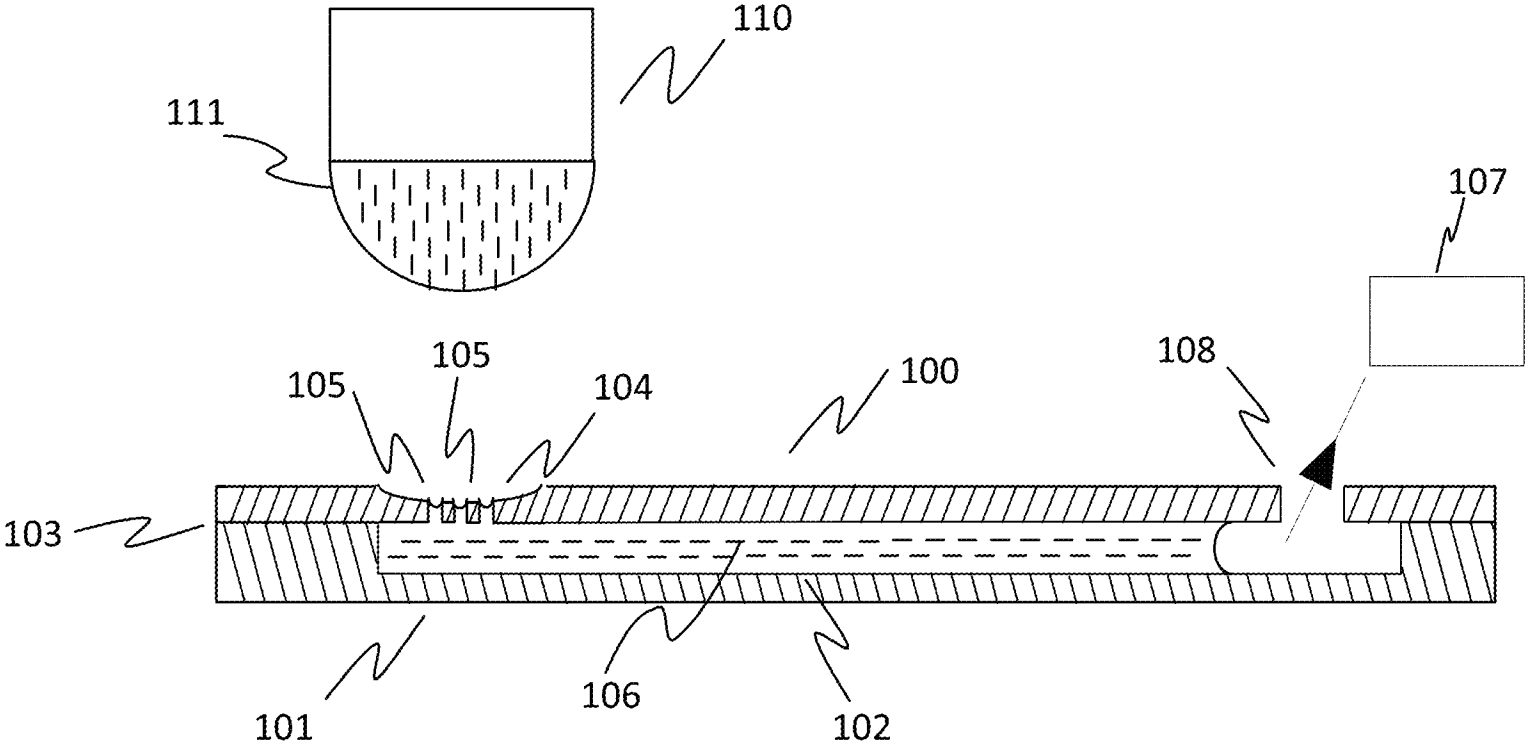
FIG. 1 illustrates an exemplary embodiment of a microfluidic system.

FIG. 1 illustrates an exemplary embodiment of a microfluidic system. The microfluidic system includes a microfluidic device 100, a pipette 110, and an external pump 107. The microfluidic device 100 includes a bottom substrate 101, a micro-channel 102, a top substrate 103, a sample inlet hole area 104, a plurality of inlet holes (hereinafter referred to as "multi hole inlet structure") 105 located in the sample inlet hole area 104, and an outlet hole 108. The diameter of each hole in the multi hole inlet structure 105 is smaller than the diameter of the sample inlet hole area 104. For description purposes, the micro-channel 102 contains a reagent 106 previously introduced into the microfluidic device 100. Pipette 110 is used to supply a reagent 111 into the micro-channel 102. More specifically, a droplet of reagent 111 is formed at a dispensing end of the pipette 110 and deposited in the sample inlet hole area 104 (see description of FIG. 2 below). External pump 107 is used to introduce/remove liquid to/from the micro-channel 102.

The following description is an example of applying an exemplary structure of the multi hole inlet structure 105 compared to a known single hole inlet structure, and the advantages provided by the multi hole inlet structure 105. In the following example, the described inlet structures are illustrated/discussed described as being tapered. In another exemplary embodiment, the inlet structures are not tapered. In additional exemplary embodiments, the concavity of the sample inlet hole area 104 can be varied to enable various degrees of capturing the contents of the droplet deposited by the pipette 110.

Figure 4A:
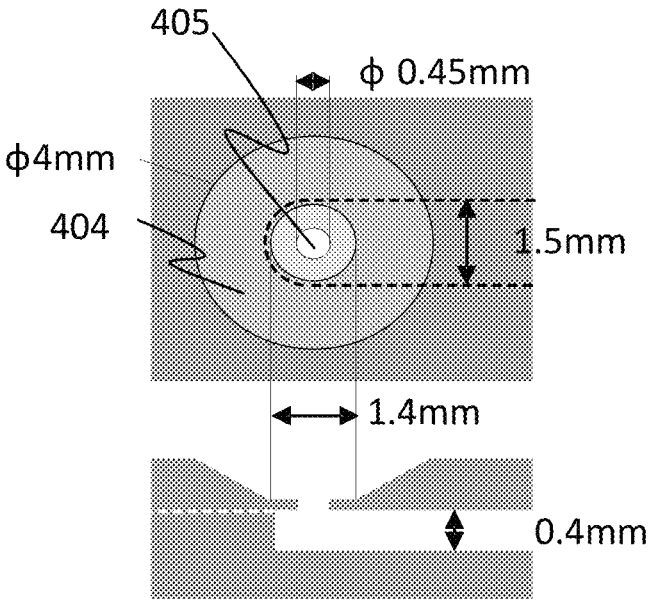
FIG. 4A illustrates an example of a known single hole inlet structure for a microfluidic device

FIG. 4A illustrates an example of a known single hole inlet structure for a microfluidic device. The microfluidic device includes a micro-channel that is 1.5 mm wide and 0.4 mm high. The sample inlet hole area 404 of the microfluidic device tapers from a diameter of 4 mm to a diameter of 1.4 mm. The single hole inlet structure 405, which is located within the sample inlet hole area 404, has a diameter of 0.45 mm, which translates into a total surface area of 0.16 $mm^2$.

Figure 4B:
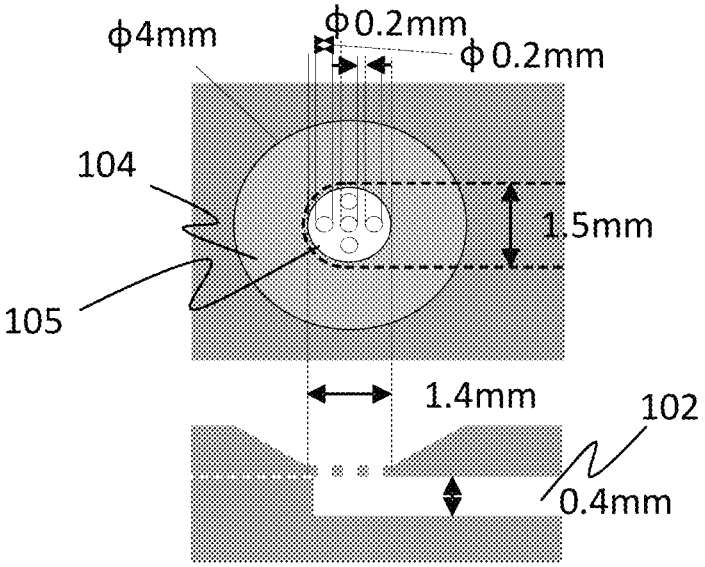
FIG. 4B illustrates an exemplary embodiment of a multi hole inlet structure for a microfluidic device.

FIG. 4B illustrates an exemplary embodiment of multi hole inlet structure 105 of microfluidic device 100. Micro-channel 102 of microfluidic device 100 is 1.5 mm wide and 0.4 mm high. The sample inlet hole area 101 of microfluidic device 100 has a diameter of 4 mm. Each of the holes in the multi hole inlet structure 105, which are located within the sample inlet hole area 104, have a diameter of 0.2 mm, which translates into a total surface area of 0.16 $mm^2$. Adding the total surface area of each of the holes that make up the multi hole inlet structure 105 results in the same total surface area as that of the single hole inlet structure. The number of holes included in the multi hole inlet structure 105 is not limited to the number of the present exemplary embodiment, and can be any number of holes greater than one.

Figure 2:
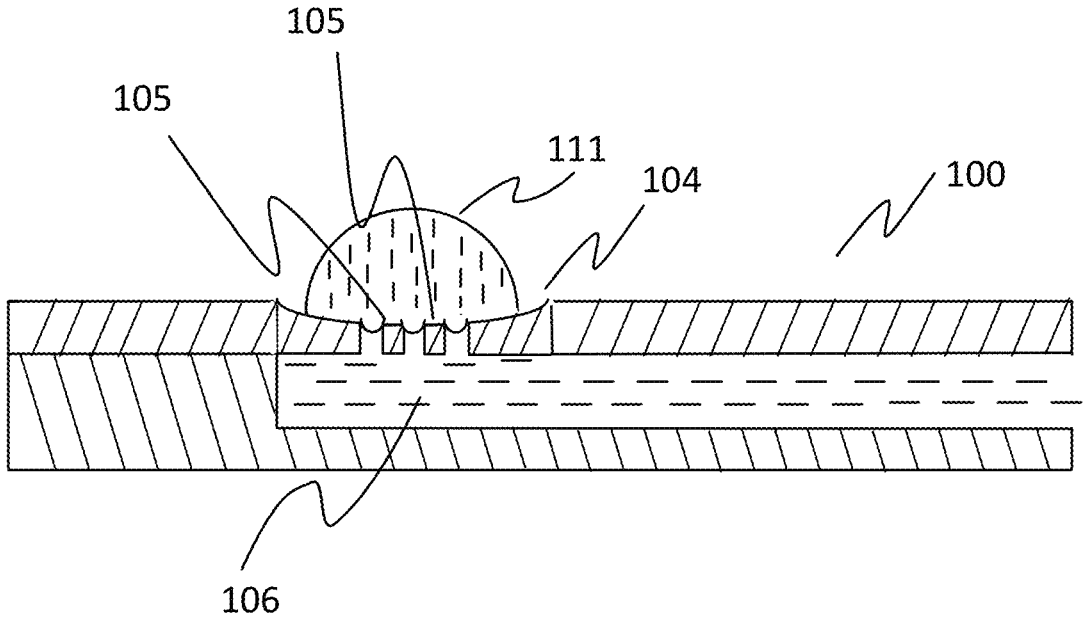
FIG. 2 illustrates an exemplary embodiment of a reagent dispensed onto a microfluidic device.
Figure 3:
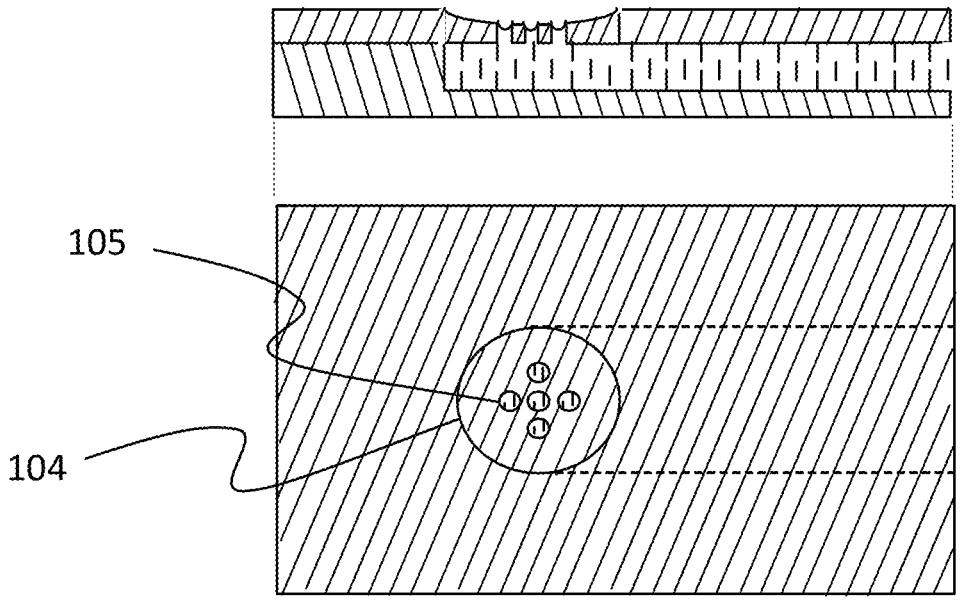
FIG. 3 illustrates an exemplary embodiment of a microfluidic device.

FIG. 2 illustrates an exemplary embodiment of reagent 111 dispensed onto the microfluidic device 100. More specifically, a droplet of reagent 111 is dispended into the sample hole inlet area 104. The concave shape of sample inlet hole area 104 prevents the droplet of reagent 111 from dispersing away from the inlet area of the microfluidic device 100.

As previously described, the microfluidic device 100 is connected to an external pump 107 via an outlet hole 108 of the microfluidic device 100. The external pump 107 is used to vacuum out the reagent 106 currently occupying the micro-channel 102 from the micro-channel 102. In the process of vacuuming out reagent 106, reagent 111 is vacuumed into the micro-channel 102 from the sample inlet hole area 104 via the multi hole inlet structure 105. More specifically, the reagent 111 is vacuumed into the micro-channel 102 through each of the holes of the multi hole inlet structure 105.

The reagent 111 continues to be pulled into the micro-channel 102 until an air-liquid interface of the reagent 111 is formed at the multi hole inlet structure 105. In this situation, the Laplace pressure at the multi hole inlet structure 105 becomes larger compared to the Laplace pressure at the single hole inlet structure 405. The vacuum pressure required is determined by the largest hole diameter of the holes inside the sample inlet hole area 104, which becomes the smallest Laplace pressure.

The following is an example to evaluate the Laplace pressure of the single inlet hole structure 405 with the Laplace pressure of the multi hole inlet structure 105. To evaluate the Laplace pressure, the total surface area of the single hole inlet structure 405 and the multi hole inlet structure 105 are aligned to 0.16 $mm^2$, which is the total surface area obtained based on the measurements described above with respect to FIGS. 4A and 4B.

The following steps are applicable to both the microfluidic device of FIG. 4A and the microfluidic device of FIG. 4B. To measure the respective Laplace pressures, 50 uL deionized (DI) water is introduced into the respective micro-channels by vacuuming until a meniscus of the DI water is formed at the respective sample inlet hole areas. Once the respective meniscuses are formed, vacuum pressure is respectively incrementally increased by 0.01 psi. Upon a new vacuum pressure being set, the pressure is respectively maintained for 30 seconds to determine whether the meniscus moved into the respective micro-channel. If there is no movement by the meniscus, the pressure is incrementally increased again and another determination is made. This is repeated until the respective meniscus breaks. When the respective meniscus breaks, the setting previous to the one at which the respective meniscus broke is determined to be the Laplace pressure for that respective structure. The determination of whether the meniscus moved into the micro-channel and if the meniscus breaks is achieved using known techniques, and as such, a detailed description of these determinations is omitted herein.

Figure 5:
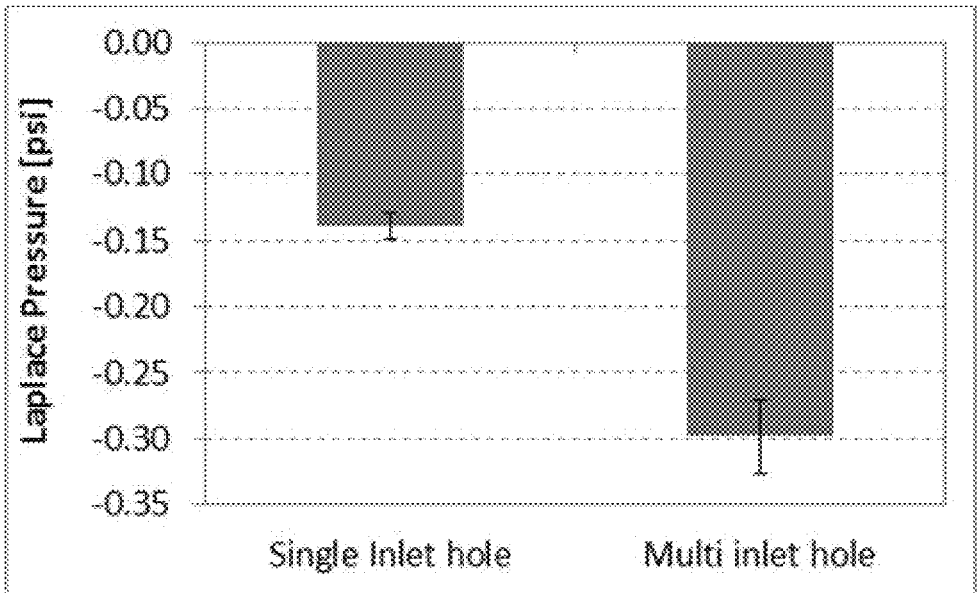
FIG. 5 illustrates an example of operational advantage of the microfluidic device of the present disclosure compared to a known microfluidic device.

FIG. 5 illustrates the Laplace pressure of the single hole inlet structure 405 vs. the Laplace pressure of the multi hole inlet structure 105. As illustrated in FIG. 5, the multi hole inlet structure 105 provides an advantage over the single hole inlet structure 405. More specifically, the Laplace pressure of the multi hole inlet structure 105 is approximately 2 times higher than the Laplace pressure of the single hole inlet structure 405. The lower Laplace pressure for the single hole inlet structure 405 requires less vacuum pressure to keep the meniscus at the micro-channel, which results in decreasing the fluid velocity due to low vacuum pressure. The higher Laplace pressure of the multi hole inlet structure 105 results in a larger vacuum pressure, which causes an increase in fluid velocity. This in turn enables shortening the operational time needed to replace a reagent in the micro-channel 102.

Figure 6:
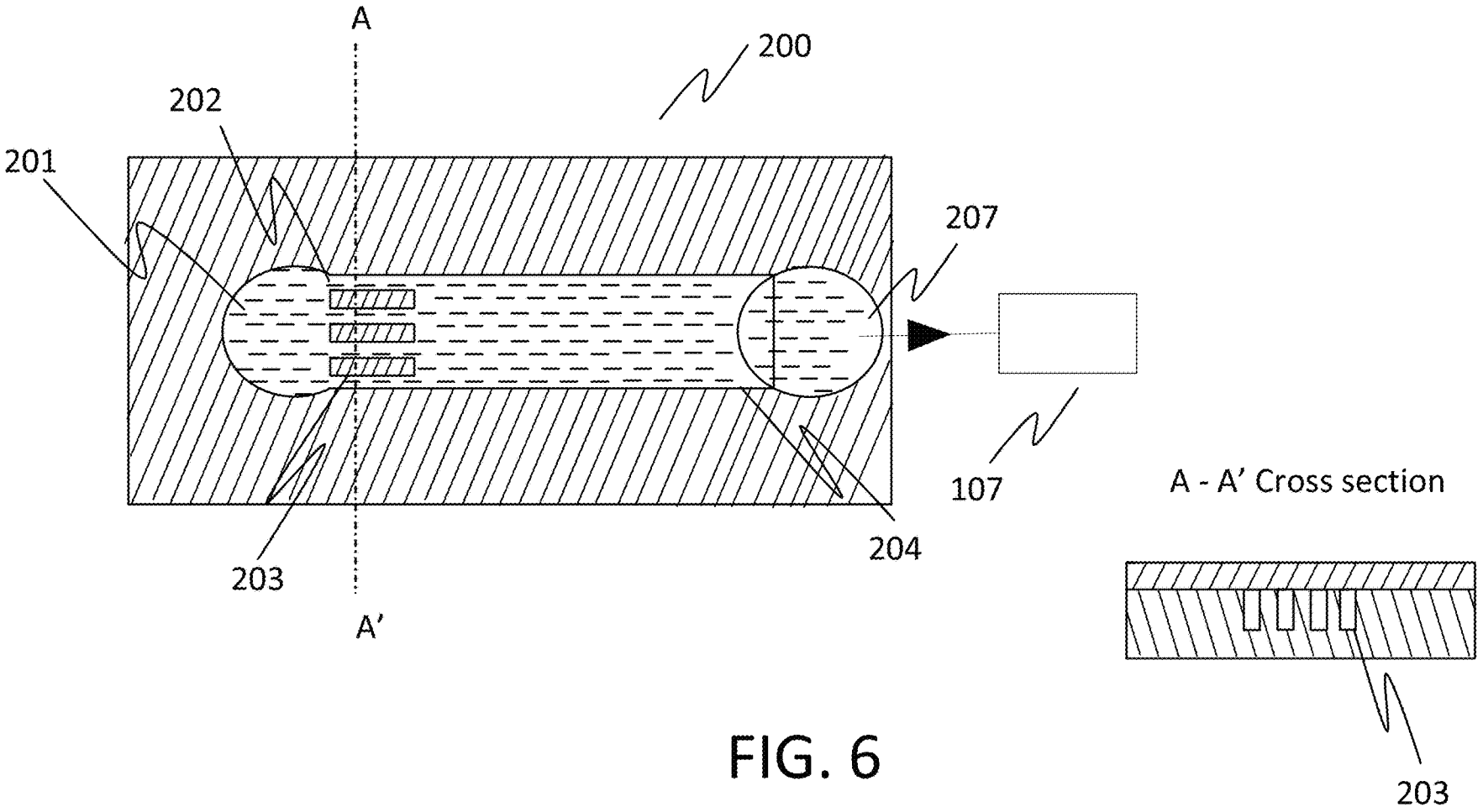
FIG. 6 illustrates an additional exemplary embodiment of a microfluidic device.

FIG. 6 illustrates an additional exemplary embodiment of a microfluidic device that can be used in the microfluidic introduction system of FIG. 1. The microfluidic device 200 includes a well 201, a single hole inlet 202, a partition 203, a micro-channel 204, and an outlet hole 207. The partition 203 is a multi-channel structure instead of the multi hole inlet structure 105 of FIG. 1, and is disposed between the well 201 and the micro-channel 204.

Figure 7:
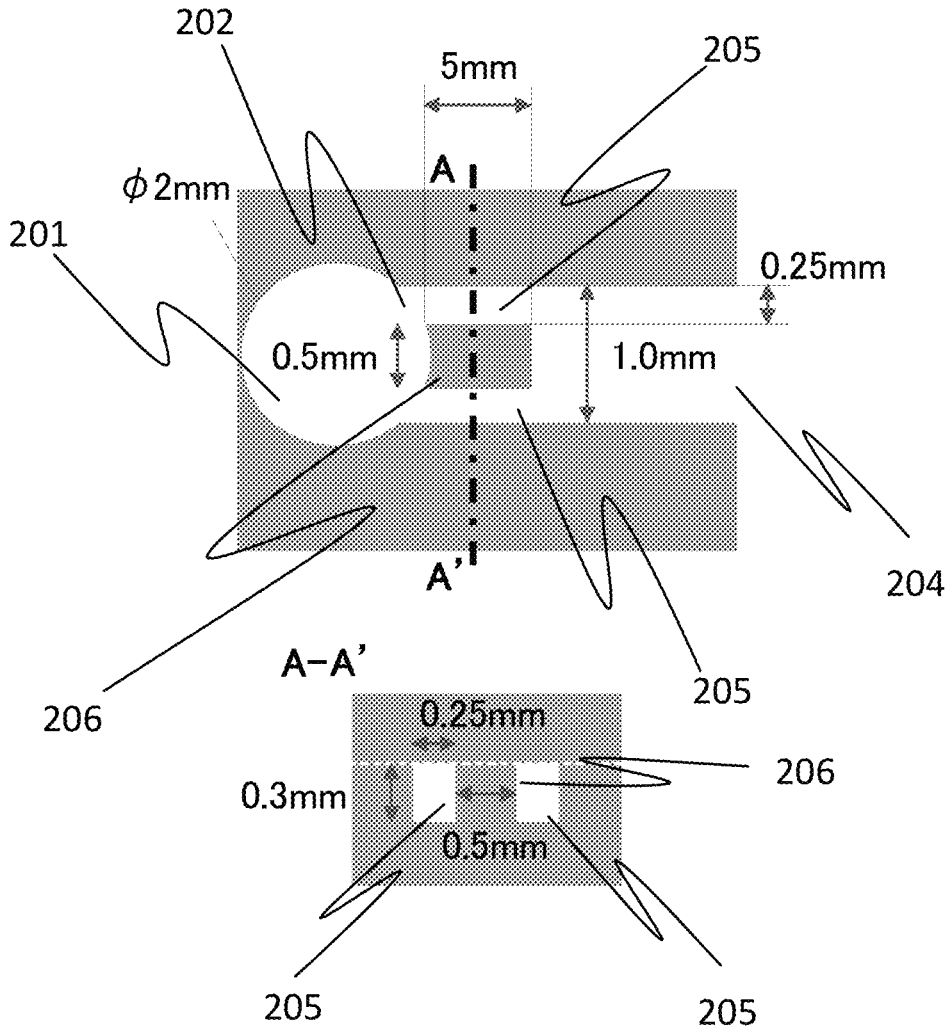
FIG. 7 is a detailed illustration of the additional exemplary embodiment of the microfluidic device.

FIG. 7 is a detailed illustration of the microfluidic device 200 of FIG. 6. The micro-channel 204 is 1.0 mm wide and 0.3 mm high. The well 201 has a diameter of 2 mm. The single hole inlet 202 is 1.0 mm wide. As described above, the partition 203 is a multi-channel structure disposed between the well 201 and the micro-channel 204. More specifically, the partition 203 is a multi-channel structure that consists of a plurality of mini-channels 205 formed by at least one partition 206. The length of each of the plurality of mini-channels 205 and the at least one partition is 5 mm. The width of each of the plurality of mini-channels is 0.25 mm, while the width of the at least one partition is 0.5 mm. While only one partition is illustrated in FIG. 7, this is not seen to be limiting, and a plurality of partitions can be implemented.

As in the above-description associated with microfluidic device 100, in the present exemplary embodiment, microfluidic device 200 is connected to an external pump 107 via an outlet hole 207. The external pump 107 is used to vacuum out a reagent currently occupying the micro-channel 204 from the micro-channel 204. In the process of vacuuming out the reagent, another reagent deposited into the well 201 is vacuumed from the well into the micro-channel 204 via the single hole inlet 202. More specifically, the reagent is vacuumed into the micro-channel 204 through each channel of the multi-channel structure that makes up the partition 203. In this case, the reagent continues to be pulled into the micro-channel 204 until an air-liquid interface of the reagent is formed at the end of the multi-channel structure.

Figure 8:
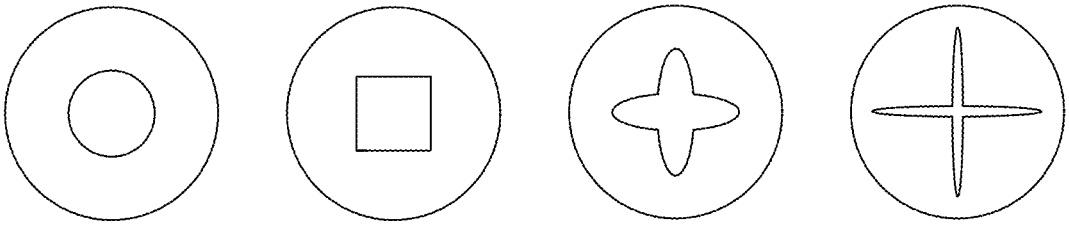
FIG. 8 illustrates examples of inlet holes of various geometrical shapes.

The above described exemplary embodiments have discussed and illustrated the holes in the multi hole inlet structure 105 as circular. These exemplary embodiments are not seen to be limiting with respect to the shape of the holes in the multi hole inlet structure 105 inlet hole area structure. FIG. 8 illustrates examples of holes of various other geometrical shapes that provide the same advantages as the above-described exemplary embodiment.

The scope of the following claims is not limited to the above-described embodiments and includes various modifications and equivalent arrangements.

What is claimed is:

1. A microfluidic system comprising:

a microfluidic device including:

at least one open inlet hole located on an inlet side of the microfluidic device and open to the atmosphere, the inlet hole including a plurality of holes with diameters smaller in size than a diameter of the at least one inlet hole;

at least one outlet hole located on an outlet side of the microfluidic device opposite the inlet side; and a micro-channel facilitating fluid communication between the at least one open inlet hole and the at least one outlet hole, wherein the plurality of holes are positioned relative to the micro-channel to enable access to the micro-channel such that the fluid passes through each of the plurality of holes in parallel; and a pressure source directly connected to the at least one outlet hole and configured to supply pressure to the micro-channel.

2. The micro-fluidic system of claim 1, wherein the diameters of the plurality of holes are equal to each other.

3. The micro-fluidic system of claim 1, wherein the diameters of the plurality of holes vary in size.

4. The micro-fluidic system of claim 1, wherein the shape of the plurality of holes vary in geometrical shape.

5. The micro-fluidic system of claim 1, wherein a liquid is introduced into the micro-channel via the plurality of holes.

6. The micro-fluidic system of claim 1, wherein the pressure source includes a pump.

7. The micro-fluidic system of claim 6, wherein the pump is configured to generate a vacuum to pull liquid into the micro-channel via the plurality of holes.

8. The micro-fluidic system of claim 7, wherein the pump pulls the liquid into the micro-channel until an air-liquid interface of the liquid is formed at the at least one open inlet hole.

9. A method comprising:

dispensing a liquid into a microfluidic device, wherein the microfluidic device includes at least one inlet hole located on an inlet side of the microfluidic device and open to the atmosphere, the inlet hole including a plurality of holes with diameters smaller in size than a diameter of the at least one inlet hole;

at least one outlet hole located on an outlet side of the microfluidic device opposite the inlet side; and a micro-channel, wherein the plurality of holes enable access to the micro-channel, wherein the plurality of holes are positioned relative to the micro-channel to enable access to the micro-channel such that the fluid passes through each of the plurality of holes in parallel; and supplying pressure to the micro-channel using a pressure source directly connected to the at least one outlet hole.

10. The method of claim 9, further comprising introducing liquid into the micro-channel via the plurality of holes.

11. The method of claim 9, wherein introducing the liquid into the micro-channel includes generating a vacuum in the micro-channel to pull the liquid into the micro-channel via the plurality of holes.

12. The method of claim 11, wherein the liquid is pulled into the micro-channel until an air-liquid interface of the liquid is formed at the at least one inlet hole.

13. A microfluidic system comprising:

a microfluidic device including:

an open well configured to receive a liquid and open to the atmosphere;

a micro-channel;

a plurality of channels disposed between the open well and the micro-channel, where the plurality of channels are smaller in size than the micro-channel; and at least one outlet hole located on an outlet side of the microfluidic device opposite a side of the open well, wherein the micro-channel facilitates liquid communication between the open well and the at least one outlet hole, wherein the plurality of channels are positioned relative to the micro-channel to enable access from the open well to the micro-channel such that the fluid passes through each of the plurality of channels in parallel; and a pressure source directly connected to the at least one outlet hole and configured to supply pressure to the micro-channel.

14. The microfluidic system of claim 13, wherein each of the plurality of channels have equal widths.

15. The microfluidic system of claim 13, wherein the plurality of channels have different widths from each other.

16. The microfluidic system of claim 13, wherein the liquid received by the open well is introduced into the micro-channel via the plurality of channels.

17. The microfluidic system of claim 13, wherein the pressure source includes a pump.

18. The microfluidic system of claim 17, wherein the pump is configured to generate a vacuum to pull liquid into the micro-channel via the plurality of channels.

19. The microfluidic system of claim 18, wherein the pump pulls the liquid into the micro-channel until an air-liquid interface of the liquid is formed at the end of the plurality of channels.

20. A method comprising:

dispensing a liquid into a microfluidic device, wherein the microfluidic device includes a well configured to receive a liquid and open to the atmosphere;

a micro-channel;

a plurality of channels disposed between the well and the micro-channel, where the plurality of channels are smaller in size than the micro-channel; and at least one outlet hole located on an outlet side of the microfluidic device opposite a side of the well;

wherein the plurality of channels enables access from the well to the micro-channel such that the liquid passes through each of the plurality of channels in parallel; and supplying pressure to the micro-channel using a pressure source directly connected to the at least one outlet hole.

* * * * *